US008414737B2

(12) United States Patent
Bouplon et al.

(10) Patent No.: US 8,414,737 B2
(45) Date of Patent: Apr. 9, 2013

(54) METHOD OF MANUFACTURING DISPOSABLE WIPERS AND TOWELS CONTAINING 40% OR MORE POST-CONSUMER WASTE

(75) Inventors: Gary Bouplon, Marinette, WI (US); Jerry Ballas, Media, PA (US); Thomas T. Ziegert, Franklin, WI (US); John C. Sellars, Wauwatosa, WI (US)

(73) Assignee: Wisconsin Note Investors, LLC, Dallas, TX (US)

( * ) Notice: Subject to any disclaimer, the term of this patent is extended or adjusted under 35 U.S.C. 154(b) by 0 days.

(21) Appl. No.: 13/449,667

(22) Filed: Apr. 18, 2012

(65) Prior Publication Data

US 2012/0199297 A1 Aug. 9, 2012

Related U.S. Application Data

(62) Division of application No. 12/414,402, filed on Mar. 30, 2009, now Pat. No. 8,282,777.

(51) Int. Cl.
*D21H 11/00* (2006.01)

(52) U.S. Cl.
USPC ..... 162/113

(58) Field of Classification Search ..... 162/113, 162/111, 112, 117, 147, 158, 169, 189, 168.1; 428/58
See application file for complete search history.

(56) References Cited

U.S. PATENT DOCUMENTS

| | | | |
|---|---|---|---|
| 3,879,257 | A | 4/1975 | Gentile et al. |
| 4,356,059 | A | 10/1982 | Hostetler |
| 6,001,218 | A | 12/1999 | Hsu et al. |
| 6,248,212 | B1 | 6/2001 | Anderson et al. |
| 6,296,736 | B1 | 10/2001 | Hsu et al. |
| 6,315,864 | B2 | 11/2001 | Anderson et al. |
| 6,464,829 | B1 | 10/2002 | Chen et al. |
| 6,582,560 | B2 | 6/2003 | Runge et al. |
| 6,585,856 | B2 | 7/2003 | Zwick et al. |
| 6,936,136 | B2 | 8/2005 | Shannon et al. |
| 6,984,290 | B2 | 1/2006 | Runge et al. |
| 7,156,953 | B2 | 1/2007 | Tirimacco et al. |
| 2003/0121627 | A1 | 7/2003 | Hu et al. |
| 2004/0112558 | A1 | 6/2004 | Garnier et al. |
| 2004/0175556 | A1 | 9/2004 | Clark et al. |
| 2004/0194901 | A1 | 10/2004 | Hu et al. |
| 2005/0129897 | A1 | 6/2005 | Zhou et al. |
| 2005/0136097 | A1 | 6/2005 | Hsu |
| 2006/0144536 | A1 | 7/2006 | Nickel et al. |
| 2006/0144541 | A1 | 7/2006 | Joy Nickel et al. |
| 2007/0044891 | A1 | 3/2007 | Sellars |
| 2007/0044930 | A1 | 3/2007 | Vinson et al. |
| 2007/0298221 | A1 | 12/2007 | Vinson |
| 2008/0000602 | A1 | 1/2008 | Dyer et al. |
| 2008/0102261 | A1 | 5/2008 | Hupp et al. |

OTHER PUBLICATIONS

Gary A. Smook, Handbook for Pulp & Paper Technologists, handbook, (2002), 6 pages, Third Edition, Angus Wilde Publications Inc., Vancouver, B.C.
US Office Action for U.S. Appl. No. 12/414,402 dated Jul. 15, 2011, 11 pages.
US Office Action for U.S. Appl. No. 12/414,402 dated Sep. 28, 2011, 3 pages.
US Office Action for U.S. Appl. No. 12/414,402 dated Oct. 20, 2011, 2 pages.
US Office Action for U.S. Appl. No. 12/414,402 dated Nov. 10, 2011, 6 pages.
Notice of Allowance from the United States Patent and Trademark Office for U.S. Appl. No. 12/414,402 dated Jun. 8, 2012 (7 pages).

*Primary Examiner* — Mark Halpern
(74) *Attorney, Agent, or Firm* — Michael Best & Friedrich LLP

(57) ABSTRACT

A method of making a disposable wiper or towel. A slurry is created by blending virgin cellulose fibers with cellulose fibers from post-consumer waste to create a mixture of cellulose fibers that contains about 40 to about 80 percent cellulose fibers from post-consumer waste. A contaminant deactivator and debonder are added to the slurry. The slurry is formed into a wet web. The wet web is pressed and adhered a Yankee dryer. The partially dried sheet is creped and dried. The sheet is wound to form a base sheet roll. The base sheet is fed to a first printer. A binder is applied to a first side of the base sheet with the first printer and then pressed into the base sheet. The base sheet is recreped and dried.

20 Claims, 7 Drawing Sheets

METHOD OF MANUFACTURING DISPOSABLE WIPERS AND TOWELS CONTAINING 40% OR MORE POST-CONSUMER WASTE

RELATED APPLICATIONS

The present application is a divisional of Ser. No. 12/414,402, entitled DISPOSABLE WIPERS AND TOWELS CONTAINING 40% OR MORE POST CONSUMER WASTE, filed on Mar. 30, 2009, the entire content of which is incorporated by reference herein.

BACKGROUND

The present invention relates to non-woven towels or wipers. More particularly, embodiments of the invention relate to a disposable wiper or towel (and methods of making the same) that meets U.S. Environmental Protection Agency ("EPA") post-consumer waste content guidelines.

Paper towels, wipers, and similar items made from non-woven materials or fabrics can be manufactured in a variety of ways. In the past, many such items were made from virgin materials. In other words, the products were made from fibers derived directly from the fiber source (e.g., trees) and not with fibers that had been previously used in a product. More recently, at least some paper towels and similar items have been made with recycled fibers. Today, there is a drive to utilize recycled fiber from post-consumer waste. The use of post-consumer waste recycled fibers is believed to both reduce energy consumption and preserve the source (e.g., forests) of the fibers used in such products.

SUMMARY

The EPA has promoted recycling by establishing a requirement that wipers have a minimum of 40% or more recycled fiber from post-consumer waste ("PCW") in order to meet EPA procurement guidelines. However, the inventors are not aware of any commercially-available, high-utility disposable wipers that meet the EPA guidelines. In fact, until the present invention, the inventors found that, in many instances, the products produced with recycled fibers are inferior, in one or more ways, to products made with virgin fibers. Furthermore, in some instances it has been commercially unfeasible to produce high-performance or high-utility towels and wipers with significant levels of recycled fiber from post consumer waste. As a consequence, there remains a need to create products with PCW recycled fibers that exhibit performance that is, at least, comparable to products that do not include post-consumer waste.

In one embodiment of the invention, a high-utility, high-performance (at least in relative terms) disposable wiper or towel (towels are usually lighter weight, low-strength wipers) is made with recycled fibers derived from post-consumer waste. The product exhibits performance characteristics that are similar to currently-available, high-utility wipers and disposable towels made with 100% virgin fibers, including wipers and towels that are made with a double-recreping process, such as the process disclosed in U.S. Pat. No. 3,879,257.

In one embodiment, the invention provides a wiper or towel that is made predominantly of cellulose fiber (85% to 90% of the wiper by weight). 40% to 80% of the cellulose fiber is bleached, semi-bleached, or unbleached PCW. A bonding material is applied to each side of the web (10% to 15% of the wiper by weight). The result is a disposable wiper that has high utility (strong in both dry and wet states, highly absorbent, abrasion resistant, thick, and soft) and that meets EPA guidelines related to the level of PCW in wipers.

One difficulty at least partially overcome by embodiments of the invention relates to the use of recycled fiber derived from PCW. In general, fibers derived from PCW are highly variable, both in physical and in chemical properties, due to the varied sources, paper grades, and prior uses of the base material. To date, this variability has limited the use of PCW recycled fiber in high-utility, disposable wipers.

The inventors have discovered a method that enhances both a base-paper process (wet-pressed, creped paper making process) and a post-treatment process (a double recreping ("DRC") process) which allows the highly-variable bleached, semi-bleached, and unbleached PCW fiber to be incorporated at levels of 40% or more (up to about 80%) of the cellulose content of the wiper. These improvements allow the manufacturing of an array of high-utility wipers and towels that meet EPA guidelines. In general, a wiper or towel produced by embodiments of the invention exhibits both wet and dry strength, has good instantaneous and total liquid (water, oil, solvent) absorbency, abrasion resistance when wiping surfaces, and tactile properties comparable to those of cloth and currently-existing, high-utility, cellulose-based wipers.

In one embodiment, the invention provides a method of making a disposable wiper or towel. The method includes creating a slurry blend of virgin cellulose fibers with cellulose fibers from post-consumer waste. The slurry blend contains about 40 to about 80 percent cellulose fibers from PCW. A contaminant deactivator and a debonder are added to the mixture. The slurry is formed into a web and the web is dried and creped into a base sheet. The base sheet is fed to a first printer. A binder is applied to a first side of the base sheet with the first printer. The binder has a relatively low viscosity (about 5 to about 20 centipoise (cps)). The binder is pressed into the base sheet. The base sheet is then re-creped, dried, and fed to a second printer. The method then includes applying a binder to a second side of the base sheet with the second printer, pressing the binder into the base sheet; re-creping the base sheet a second time; and drying the base sheet a second time. The now double re-creped sheet is heated in a curing oven to cure the binder. The base sheet is cooled and may be wound into rolls or converted to desirable sizes and configurations.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. The product produced can also be used for other purposes than towels and wipers—e.g., as construction medium for the production of wet wipes; absorbent bed sheets; filtration medium; sound and heat insulating medium; limited-reuse, low-cost clothing; and/or environmental protection garments.

As noted above, producing a towel or wiper of the present invention involves at least two major steps. First, a base sheet is produced. Second, the base sheet is printed, double re-creped, and wound on a roll. Of course, once a roll of double re-creped material is formed, further processes may be carried out (e.g., "converting") in which the material is, for example, cut, slit, perforated, and wound on smaller rolls suitable for sale to consumers (such as in a form that resembles rolls of paper towels commercially available in the U.S. at supermarkets and other stores). It can also be sold in roll form to converters as a construction material for use in applications as listed above.

Figure 1:
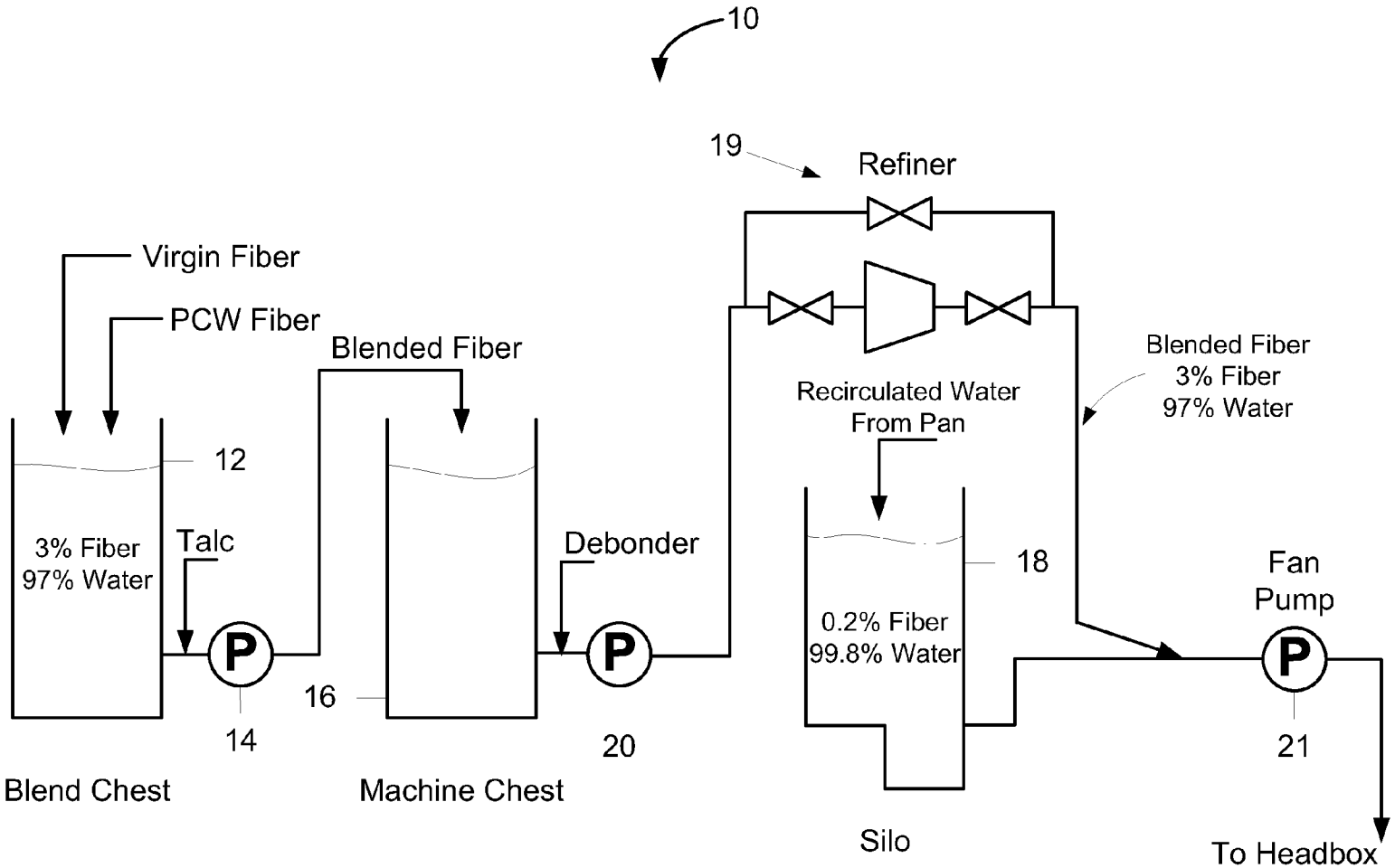
FIG. 1 is a schematic illustration of a first part of a manufacturing line designed to produce a base sheet or paper that is made with recycled fibers from PCW.

FIG. 1 illustrates part of a paper machine or base-sheet manufacturing line 10 in which a fibrous web containing 40% or more bleached, semi-bleached, or unbleached PCW (having a basis weight of about 25 to about 55 pounds per ream of 3000 square feet) is formed from an aqueous slurry of fibers. The fibrous web is formed under conditions where inter-fiber bonding is reduced by 40% to 70% as compared to paper webs of similar weight produced in a conventional manner. A wet-pressed, creped, paper machine process is carried out in the paper machine line 10.

The paper machine line 10 (shown schematically) includes a blend chest 12. A mixture of virgin fiber slurry and PCW fiber slurry is added to the chest 12. The slurry in the blend chest is controlled so that the slurry contains approximately 3% fiber (i.e., the total fiber from the virgin fiber slurry and the PCW fiber slurry) and 97% water. Instead of adding a virgin fiber slurry and a PCW fiber slurry to the blend chest, it is possible to mix the fibers in a dry state and then add the dry mixture and water to the blend chest. Other variations of mixing the fibers with water are possible. Regardless of the exact manner in which the ingredients are delivered to the blend chest 12, the ultimate goal is to create a slurry that contains a desired fiber-to-water ratio, such as the 3% fiber to 97% water ratio mentioned above. In at least some embodiments, bleached, semi-bleached, or unbleached recycled fiber with high levels of PCW content is blended with other papermaking fibers, preferably Northern and/or Southern softwood, so that the fiber content of the slurry is 40% or more of bleached, semi-bleached, or unbleached PCW.

The slurry in the blend chest 12 is pumped by a pump 14 to a machine chest 16. Talc, at the addition rate of about 5 to about 25 pounds/tons of fiber, is added to the slurry as it exits the blend chest 12. The talc acts as a contaminant neutralizer or deactivator and helps to capture and deactivate contaminants that are present on or with the fibers of the PCW. The slurry is pumped from the machine chest 16 to a silo 18 by a pump 20. A refiner (or deflaker) 19 can be run or bypassed depending on the characteristics of the blended slurry and the desired end product. Debonder is added to the slurry as it exits the machine chest 16. The debonder may be one of a number of commercially available debonders available from a number of sources. It is added at rates of about 10 to about 30 pounds/ton of fiber (0.5% to 1.5%). This helps to reduce the level of hydrogen bonds formed as water is removed from the dilute slurry and the cellulose fibers come into intimate contact with one another in the paper making process. The silo receives recirculated water from downstream processes. The slurry in the silo includes about 0.2% fiber and about 99.8% water and is used to dilute the blended stock to the 0.5% fiber and 99.5% water desired for forming the sheet.

Figure 2:
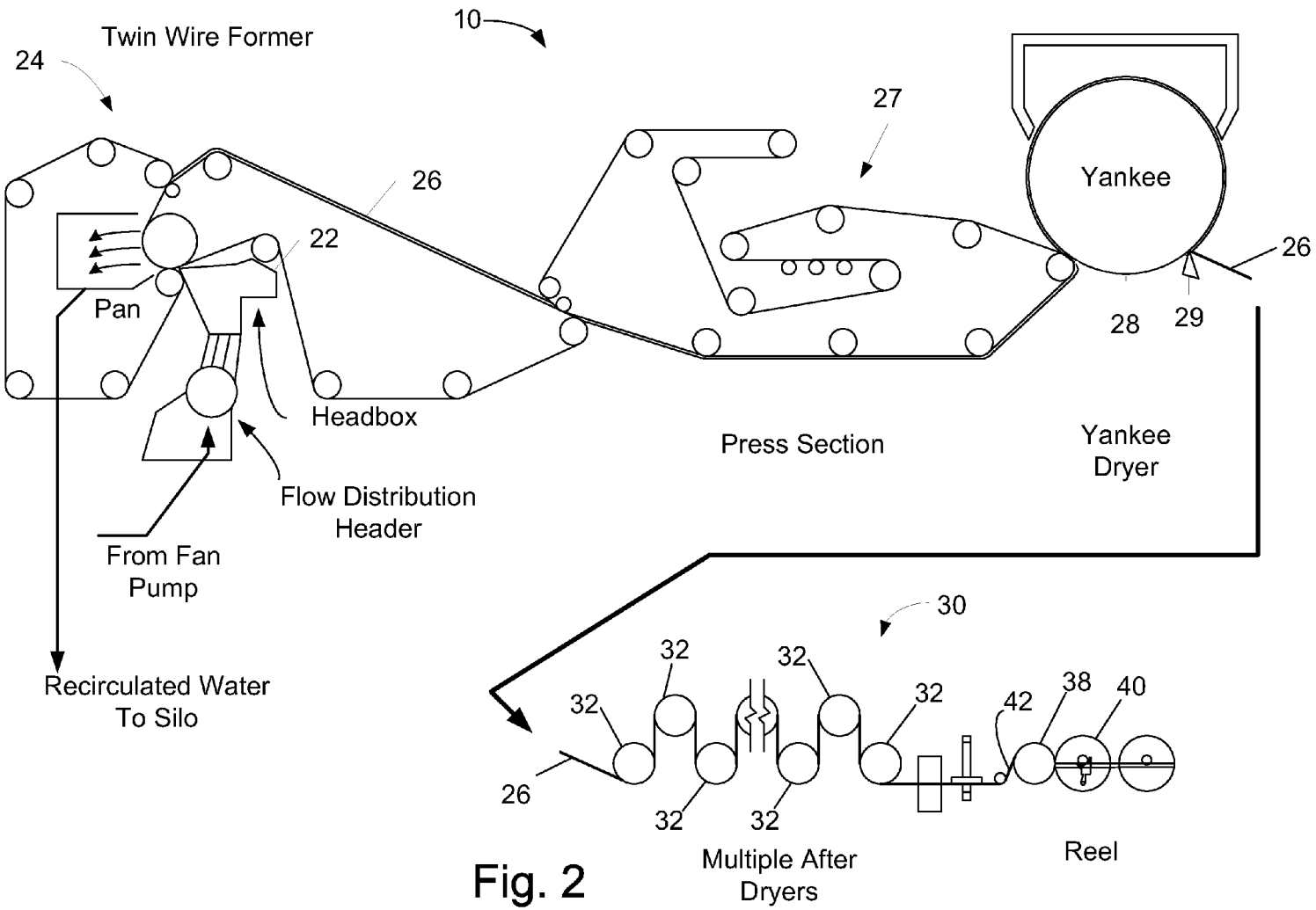
FIG. 2 is a schematic illustration of a second part of a manufacturing line designed to produce a base sheet that is made with recycled fibers from PCW.

Blended stock from the refiners is mixed in line with slurry from the silo 18 and pumped by a fan pump 21 to a headbox 22 (FIG. 2) of a twin wire former 24. In other embodiments of the invention, other commercially available formers can be used in lieu of the twin wire former 24. The former 24 produces a fibrous web or sheet 26. The sheet 26 is formed so that uniform distribution of the PCW within the sheet is achieved and so that both sheet surfaces are nearly equivalent. Additional steps—minimized chest retention, no or minimal refining, and controlled fines recapture and reuse—are taken to minimize hydration (a process that increases hydrogen bonding) of the fiber between the blending and paper forming steps.

The formed sheet 26 is transferred to a press section 27. A felt/pressure roll configuration is used in the embodiment shown and the sheet 26 is pressed against a Yankee dryer 28. In order to limit the creation of hydrogen bonds (some of which are created despite the addition of debonder) and to avoid bulk (thickness) reduction, pressure roll loading (in the felt/pressure roll configuration) is reduced to relatively low levels (about 300 to 350 pounds per linear inch ("PLI")). The sheet 26 adheres to the surface of the Yankee dryer 28. As noted earlier, debonder is added to the slurry to reduce the formation of hydrogen bonds. The amount of debonder is greater than that used in at least several other paper making processes. The relatively high level of debonder makes it difficult to control the sheet 26 on the Yankee dryer 28 and to consistently crepe the sheet 26 with a creping blade or doctor 29. To help achieve positive control of the sheet 26, sheet moisture content is controlled and chemicals are sprayed on the Yankee dryer 28 to properly adhere the sheet 26 to the dryer and then crepe it with the creping doctor 29. Adhesives and release modifiers (chemicals) for Yankee dryers are known in the paper making industry and commercially available from a number of sources. In one embodiment, addition of an adhesion chemical or adhesive is controlled to 2.2 $mg/M^2$ of Yankee dryer surface (+/−) 0.7 $mg/M^2$ depending on sheet basis weight. Addition of the release modifier or release chemical helps ensure constant crepe generation and is controlled, in one embodiment, to 10.0 $mg/M^2$ of Yankee dryer surface+/−2.0 $mg/M^2$. Sheet dryness is controlled to less than about 80% to further inhibit inter-fiber bond formation due to drying. After the sheet 26 is creped, it is transferred to an after-dryer section 30 (or, more simply, an after dryer) having multiple steam-heated dryers 32.

As a result of the efforts to reduce inter-fiber bonding, the sheet 26 is relatively weak. In order to transport the sheet through the after-dryer section 30 without disrupting or damaging it, a double-felted, after-drying configuration is used. The sheet 26 is physically restrained in a sandwich between the two dryer felts (not shown) and transported through the after-drying section 30. This enables the process to operate with minimum sheet defects and sheet breaks. This, in turn, allows commercial paper machine efficiency to be achieved. Other modes of sheet after-drying providing positive sheet control can also be employed to remove water from the web.

Once dried to a level of about 96%+/−1%, the sheet 26 is fed to a reel 38 where the sheet is wound to form one or more rolls 40. At this stage in the process, the sheet is considered to be a base paper ready for post treatment and is labeled with reference numeral 42. Thus, the roll 40 can be referred to as a roll of base paper. In one embodiment, the reel 38 is configured so that the relative speed between the reel 38 and the after-dryer section 30 is +0.7%+/−0.1%. The loading between the reel and the base paper roll 40 is maintained at a low nip loading (0.5 to 2 PLI). When the reel is so operated, compaction and bulk reduction of the base paper 42 is reduced. As a result of the process described above with respect to the line 10, it is possible to create a cellulose web (i.e., the base paper 42) with 40% or more PCW in a basis weight range of 20 pounds to 50 pounds per ream and with the characteristics set forth in Table 1.

TABLE 1

| Base Sheet | |
|---|---|
| Property | Base Sheet/Base Paper |
| Basis Weight (pounds/3000 sq. ft.) | 20 to 40 |
| Thickness (mils/ply) | 4 to 9 |
| Machine Direction Tensile Strength (gm./in.) | 400 to 1200 |
| Cross Direction Tensile Strength (gm./in.) | 200 to 700 |
| Web Dryness (%) | 95% to 97% |

When the base paper 42 is manufactured as outlined, tensile strength is reduced by 40% to 70%, and web thickness is increased by 20% to 40% (as compared to paper webs of similar weight produced in a conventional manner). The improved bulk creates a bulk-to-basis weight ratio of 1.7 to 2.1 (mils per 8 ply/pounds per ream). These properties and the methods in which they are achieved make the base paper 42 (with 40% or more PCW) suitable for post treatment in a DRC process.

Figure 3:
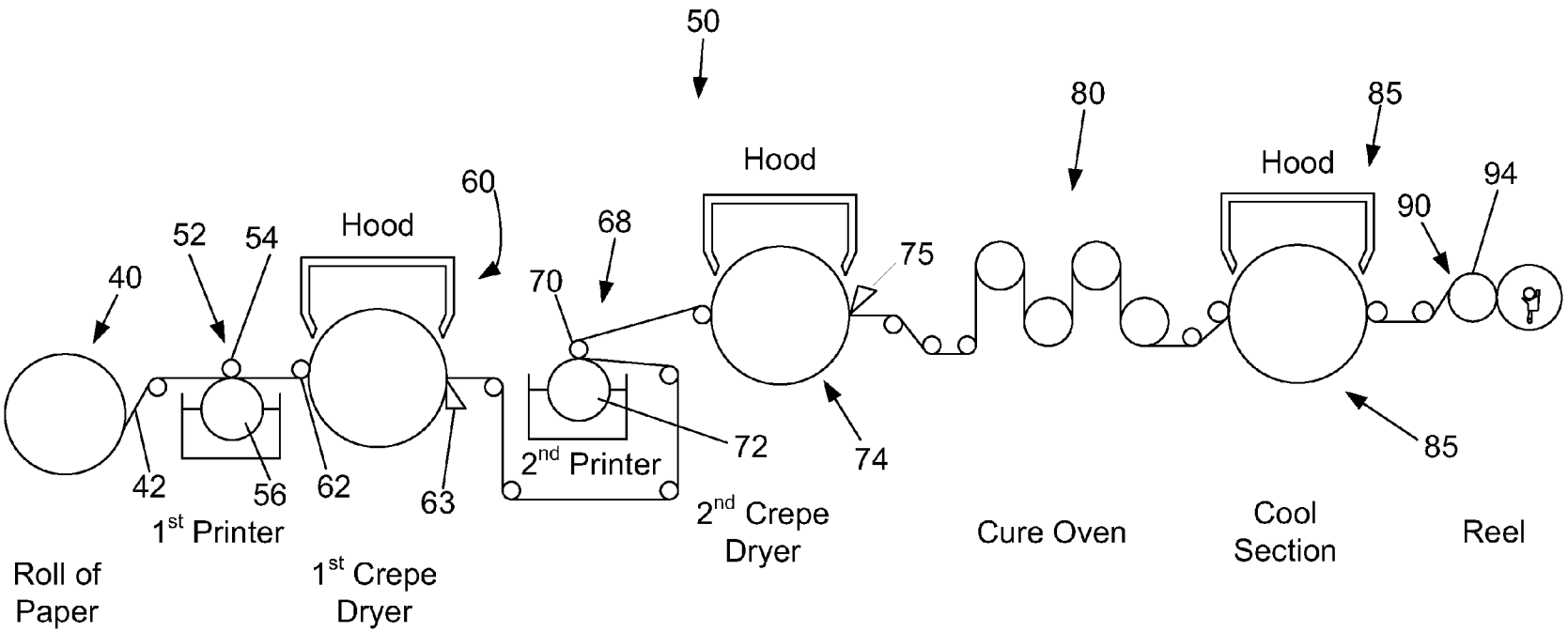
FIG. 3 is a schematic illustration of a manufacturing line in which the base sheet produced on the manufacturing line illustrated in FIGS. 1 and 2 is printed and re-creped and then wound on a roll.

FIG. 3 illustrates a manufacturing line 50 in which the base paper 42 is re-creped. A roll (such as the roll 40) of base paper is unwound so that the base paper 42 is fed to a printer 52 having two rollers or rolls: an impression roll 54 and a fine pattern engraved roll 56. A binder emulsion is applied or printed on a first side of the base paper 42 using the fine pattern engraved roll 56. The pattern covers 25% to 50% of the surface area of the first side of the base paper 42 with a binder that penetrates into 30% to 60% of the sheet thickness. This level of penetration range ensures sheet integrity so that the web does not split apart (referred to as delamination) when in finished-product form. However, proper printing of the binder emulsion on the base paper 42 is difficult (as compared to printing on a base sheet of virgin fiber) due to the presence of relatively short, compacted, and variable fibers having variable levels of water resistance or repellency present in the PCW used to make the base paper. To help achieve a desired range of binder penetration, the viscosity of the binder emulsion is adjusted to a level of about 5 to 20 cps. To achieve this viscosity level, a low-viscosity binder (such as styrene butadiene rubber, acrylic or vinyl acetate homopolymer, or copolymer latex having an as received viscosity of 100 cps or less when measured by a Brookfield viscometer) is used. Solids in the binder emulsion are adjusted to a range of about 25% to about 33% to achieve a final desired viscosity (i.e., the 5 to 20 cps mentioned above).

In addition to adjusting the viscosity of the binder emulsion, to further assist achieving proper binder penetration, the binder is pressed (using an automatically variable pressure control system) into the base paper 42 by the impression roll 54. The level of pressing is automatically adjusted over a range of about 30 to 65 PLI based on the thickness of the web as it is wound at the end of the process. If the measured thickness is above a target setting, the pressing is automatically increased. If the measured thickness is below the target setting, the pressing is automatically decreased.

Figure 4:
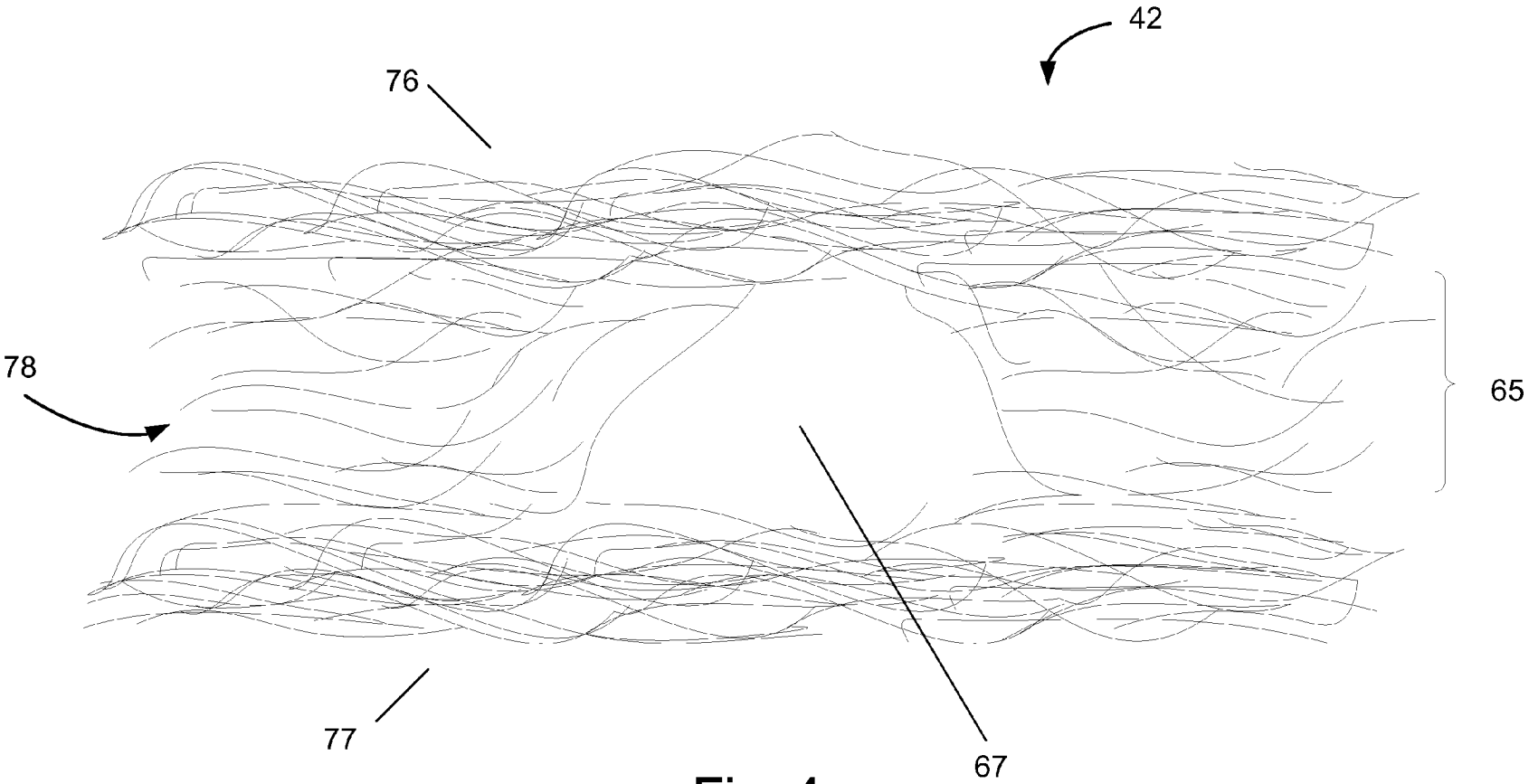
FIG. 4 is a schematic illustration of the sheet structure of a double-recreped, 40% PCW content wiper.

After the first side of the base paper 42 is printed with binder by the printer 52, the base paper 42 is pressed onto a creping dryer 60 by a press roll 62. The sheet is dried to a 93% to 96% dryness level and re-creped by a crepe doctor 63. The loading of the crepe doctor is set in a range or about 15 to 40 PLI. The surface temperature of the creping dryer is controlled in a range of about 180° F. to about 230° F. The action of the creping blade on the base paper 42 as it is "creped" from the dryer loosens and breaks apart many of the weak hydrogen bonds in a central area 65 of the sheet 42 (see FIG. 4). However, fibers that are encapsulated with bonding material are not affected by the creping action. This causes many of the fibers in the central region 65 of the web to be oriented in the z direction. In addition, it creates voids 67 in the central area of the web. The resultant internal web structure enhances bulk (thickness), softness, and substantially increases liquid absorbing capacity.

Figure 5:
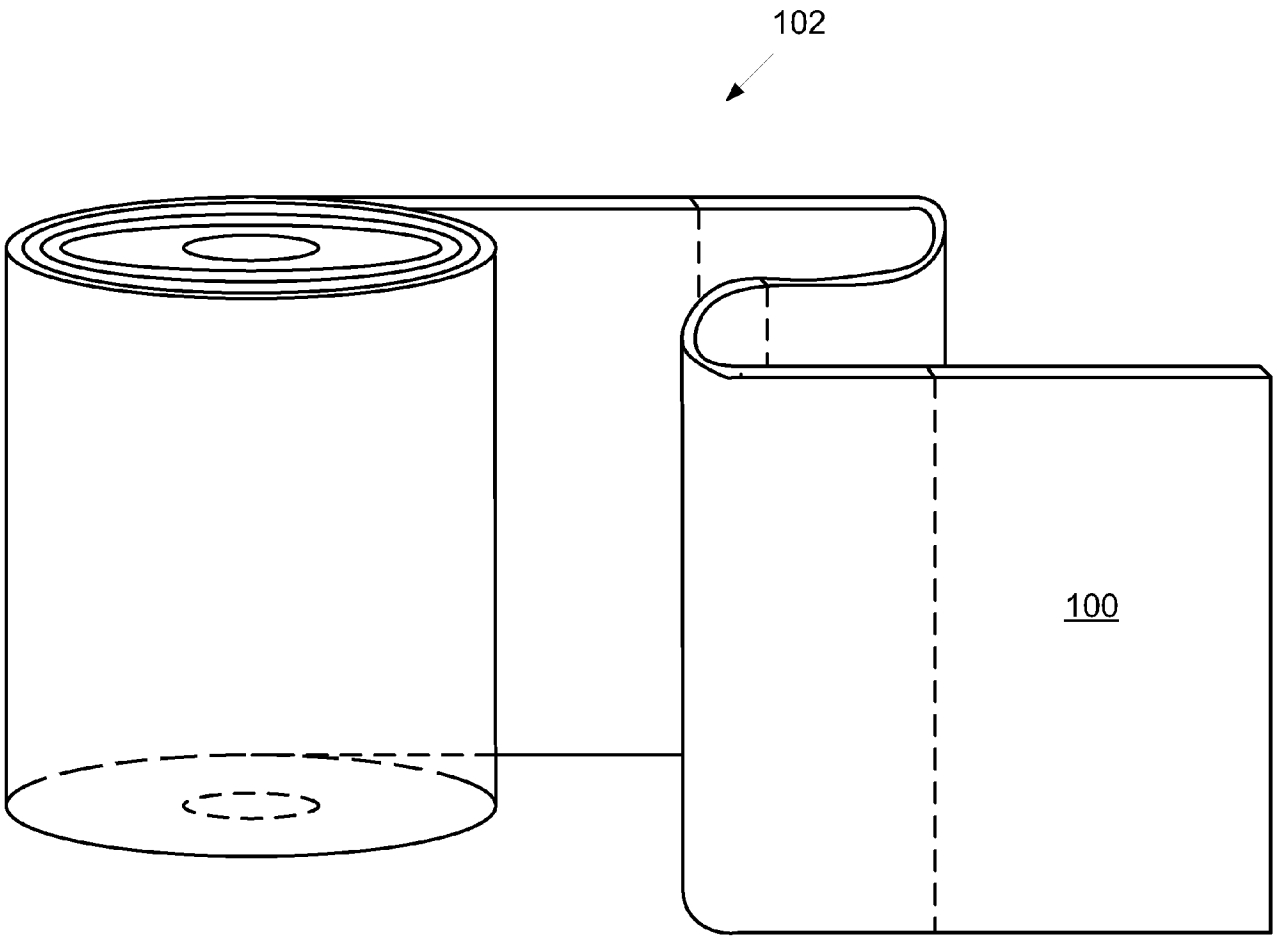
FIG. 5 is an illustration of a towel made from the material produced as a result of the processes carried out in the manufacturing lines of FIGS. 1, 2, and 3.

After the first side of the base paper 42 is printed, dried, and creped the other side of the sheet is printed with a binder emulsion, dried, and creped in the same manner. Thus, the manufacturing line 50 includes a second printer 68 having two rollers or rolls: an impression roll 70 and a fine pattern engraved roll 72. The manufacturing line also includes a second creping dryer 74 with a crepe doctor 75. As with the first side of the base paper 42, binder emulsion is applied to the second side of the sheet to achieve a penetration range of about 20% to 50% of the sheet thickness. The effect of printing both sides of the base paper 42 with this range of binder penetration (30% to 60% on the first side and 20% to 50% on the second side) is akin to "stapling" of the two sides of the sheet at fiber intersections and achieves a desired internal bonding strength of the finished sheet (as measured by z-peel strength). At the same time, the double re-creping of the base paper creates the loose internal web structure. The result (as shown in FIG. 5) is a web with high bonded fiber concentration on the surface (top surface 76 and bottom surface 77) which provides good wiping and abrasive characteristics and looser fibers 78 and voids 67 in the central region of the web which creates enhanced bulk, softness, and absorbency characteristics. The "stapling" effect of the binder penetration ensures sufficient bonding in the center of the web to achieve the desired resistance to delamination (as measured by z-peel strength) to maintain sheet integrity in use.

Referring back to FIG. 3, after the second side of the base paper 42 is printed, dried, and re-creped, the base paper 42 is fed to a cure oven 80. The base paper 42 is heated to a temperature of about 300° F. to about 370° F. in the cure oven 80 to cure the binder to greater than 85% of its maximum potential. Curing causes the polymer chains of the binder to bond (crosslink), making the binder water resistant. Curing also ensures that desired levels of dry and wet strength of the base paper 42 are achieved. As the binder on the base paper is cured to greater that 85% of its maximum potential, the resultant ratio of wet strength to dry strength of 55% to 65% is achieved. This provides for superior strength when wet and high utility for wiping and cleaning tasks. After curing, the sheet is cooled to a temperature of less than about 95° F. at a cooling station 85 and wound with a reel 90 into a roll 94. The roll 94 of the base paper 42 may be moved or shipped to a converting line so that the sheet may be formed into end products of desired sizes and configurations, such as roll towels or wipers and folded towels or wipers.

Figure 6:
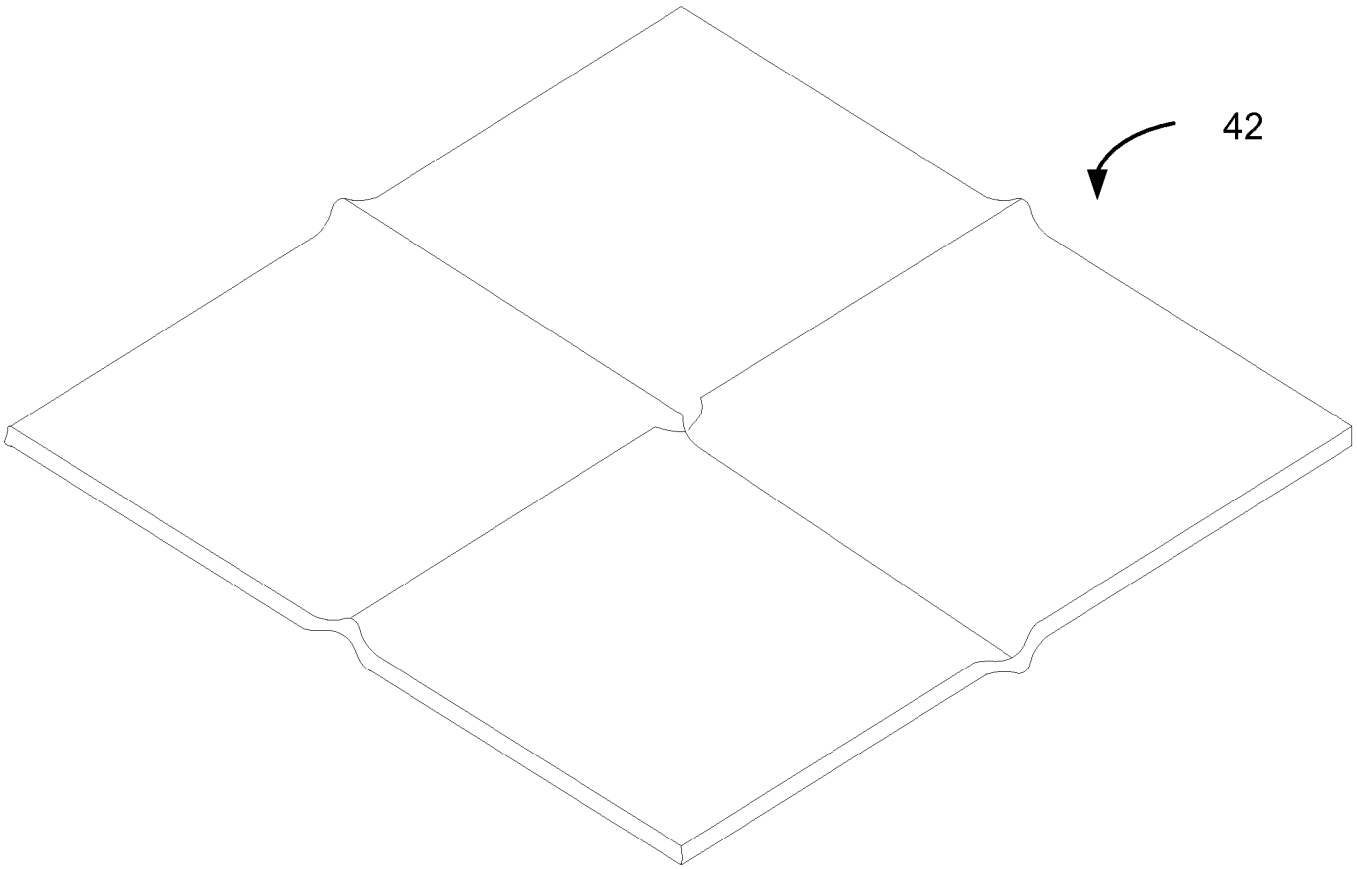
FIG. 6 is an illustration of a quarter-folded product made from the material produced as a result of the processes carried out in the manufacturing lines of FIGS. 1, 2, and 3.
Figure 7B:
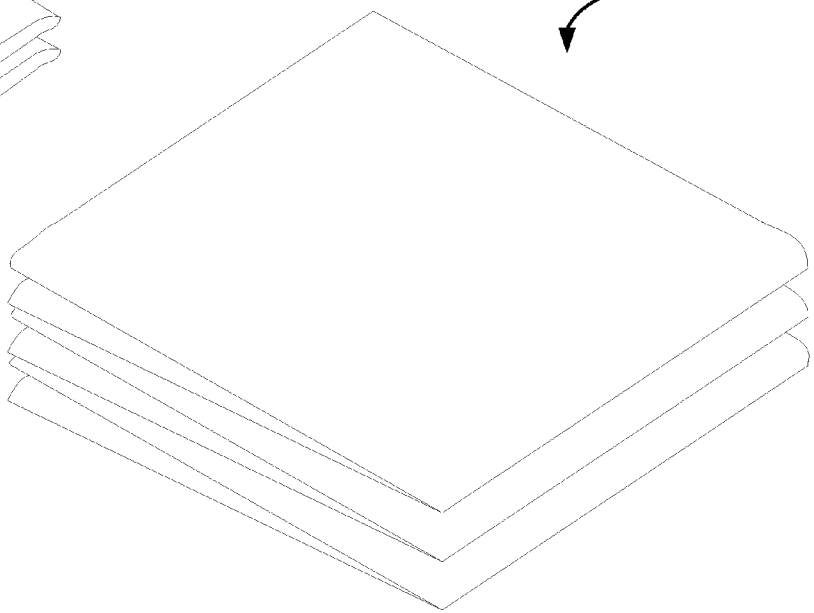
FIG. 7B is an illustration of the stack of quarter-folded products from a different point of view.
Figure 7A:
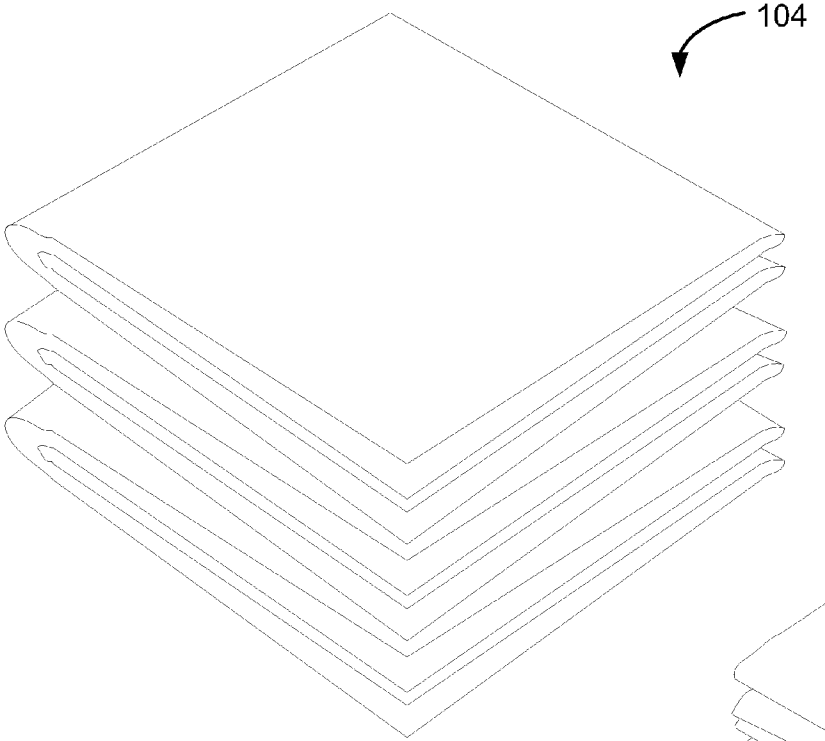
FIG. 7A is an illustration of a stack of quarter-folded products.

FIG. 5 illustrates a towel or wiper 100 that is produced by converting the roll 94 of base paper 42 into a desired end product, which as shown in FIG. 5 is a roll 102 of towels with perforations between each towel. FIG. 6 illustrates another product that can be produced, namely a quarter-folded towel or wiper 102. A stack 104 of such wipers is shown in FIGS. 7A and 7B from two different perspectives. Using the processes described above, examples of wipers with the characteristics set forth in Table 2 were created.

TABLE 2

Sample 40% PCW Content Wipers

| Property | 34.5# Wiper | 47# Wiper |
|---|---|---|
| Basis Weight (pounds/ream) | 34.5 | 47.0 |
| Bulk (mils) | 20-22 | 27-30 |
| MD Tensile (grams/inch) | 1000 | 1150 |
| MD Stretch (%) | 20% | 25.0 |
| CD Tensile (grams/inch) | 750 | 900 |
| CD Wet Tensile (grams/inch) | 450 | 550 |
| Wet Tensile/Dry Tensile | 60% | 61% |
| LAC (Liquid Absorptive Capacity %) | 600 | 700 |
| Z-peel (delamination grams/inch)) | 40 | 40 |
| Cellulose Content: | | |
| Virgin Fiber (Softwood) | 45% | 45% |
| Recycled (Post Cons. Waste) | 40% | 40% |
| Recycled (Post Ind. Waste ("PIW")) | 15% | 15% |

Note that the examples set forth in Table 2 have an amount of recycled fibers of 50% or more (in the particular example the total is about 55% recycled fibers (40% PCW and 15% PIW)).

Table 3 sets out characteristics of high-performance or high-utility wipers or towels that do not have 40% post consumer waste (i.e., they were made from a base sheet composed of virgin or nearly all virgin fibers).

TABLE 3

Sample High-Utility Towels with Little or No PCW

| Property | KC L-30 | KC L-40 |
|---|---|---|
| Basis Weight (pounds/ream) | 35.1 | 50.5 |
| Bulk (mils) | 19.5 | 28.6 |
| MD Tensile (grams/inch) | 1050 | 1175 |
| MD Stretch (%) | 23.0 | 25.0 |
| CD Tensile (grams/inch) | 775 | 875 |
| CD Wet Tensile (grams/inch) | 460 | 490 |
| Wet Tensile/Dry Tensile | 59% | 56% |
| LAC (Liquid Absorptive Capacity %) | 620 | 716 |
| Z-peel (delamination grams/inch)) | 85 | 46 |

As can be seen by a comparison of Tables 2 and 3, embodiments of the invention provide, among other things, a towel or wiper containing at least 40% PCW fiber with characteristics that are comparable and, in some circumstances, better than wipers that do not include such levels of PCW. Various features and advantages of the invention are set forth in the following claims.

What is claimed is:

1. A method of making a disposable wiper or towel, the method comprising:

creating a slurry including blending virgin cellulose fibers with cellulose fibers from post-consumer waste to create a mixture of cellulose fibers that contains about 40 to about 80 percent cellulose fibers from post-consumer waste;

adding a contaminant deactivator to the slurry;

adding a debonder to the slurry;

forming the slurry into a wet web;

pressing and adhering the wet web to a Yankee dryer to create a partially dried sheet;

creping the partially dried sheet;

drying the resultant sheet under support and control;

winding the sheet to form a base sheet roll;

feeding the base sheet to a first printer;

applying a binder to a first side of the base sheet with the first printer, the binder having a viscosity of about 5 to about 20 cps;

pressing the binder into the base sheet;

recreping the base sheet a first time; and drying the recreped base sheet a first time.

2. A method as in claim 1, the method further comprising:

feeding the dried recreped base sheet to a second printer;

applying a binder to a second side of the base sheet with the second printer, the binder having a viscosity of about 5 to about 20 cps;

pressing the binder into the base sheet;

recreping the base sheet a second time;

drying the double recreped base sheet a second time;

curing the binder applied in a curing oven; and cooling the resultant double recreped sheet.

3. A method as in claim 1, wherein forming the slurry into a wet web includes, providing the slurry to a former; and creating a web of fibers in the former.

4. A method as in claim 3, further comprising applying an adhesive to the Yankee dryer and applying a release agent to the Yankee dryer.

5. A method as in claim 4, the method further comprising controlling dryness of the wet web.

6. A method as in claim 1, wherein drying the resultant sheet under support and control includes transferring the sheet to an after-dryer section.

7. A method of claim 1 wherein recreping the base sheet a first time increases bulk, softness and liquid absorbing capacity.

8. A method of claim 2 wherein recreping the base sheet a second time creates a loose internal web structure.

9. A method of making a disposable wiper or towel, the method comprising:

creating a slurry including blending virgin cellulose fibers with cellulose fibers from post-consumer waste to create a mixture of cellulose fibers that contains about 40 to about 80 percent cellulose fibers from post-consumer waste;

adding a contaminant deactivator to the slurry;

adding a debonder to the slurry;

forming the slurry into a wet web;

pressing and adhering the wet web to a Yankee dryer to create a partially dried sheet;

creping the partially dried sheet;

drying the resultant sheet under support and control to form a base sheet;

feeding the base sheet to a first printer;

applying a binder to a first side of the base sheet with the first printer;

pressing the binder into the base sheet;

recreping the base sheet a first time; and drying the recreped base sheet a first time.

10. A method of claim 9, wherein forming the slurry into a wet web includes minimizing hydration.

11. A method of claim 9, wherein pressing and adhering the wet web to a Yankee dryer is accomplished at least in part by using a felt/press roll configuration.

12. A method of claim 11, wherein pressing and adhering the wet web to a Yankee dryer is achieved under press-roll loading levels of about 300 pounds per linear inch to about 350 pound per linear inch limiting the creating of hydrogen bonds.

13. A method of claim 11, wherein pressing and adhering the wet web to a Yankee dryer includes adding an adhesive.

14. A method of claim 9, wherein creping the partially dried sheet includes adding a release modifier.

15. A method as in claim 9, wherein drying the resultant sheet under support and control includes transferring the sheet to an after-dryer section.

16. A method claim 9, wherein the binder has a viscosity of about 5 to about 20 cps.

17. A method of claim 9, wherein pressing the binder into the base sheet includes automatically adjusting the level of pressing over a range of about 30 pounds per linear inch to about 65 pounds per linear inch.

18. A method of claim 17, wherein automatically adjusting the level of pressing includes measuring a thickness of the web.

19. A method of claim 18, wherein automatically adjusting the level of pressing includes increasing the pressing level if the measured thickness is above a target setting.

20. A method of claim 18, wherein automatically adjusting the level of pressing includes decreasing the pressing level if the measured thickness is below a target setting.

* * * * *